United States Patent [19]

Rusnak

[11] 4,306,723

[45] Dec. 22, 1981

[54] GOLF SWING TRAINING APPARATUS

[76] Inventor: Thomas L. Rusnak, 349 Toftrees Ave., Apt. 210, State College, Pa. 16801

[21] Appl. No.: 175,256

[22] Filed: Aug. 4, 1980

Related U.S. Application Data

[63] Continuation-in-part of Ser. No. 962,757, Nov. 21, 1978, Pat. No. 4,254,956.

[51] Int. Cl.[3] ..... A63B 69/36

[52] U.S. Cl. ..... 273/186 R; 273/DIG. 26

[58] Field of Search ..... 273/186 R, 186 RA, 186 A, 273/186 B, 186 C, 185 R, 184 R, 181 H, DIG. 26, DIG. 28

[56] References Cited

U.S. PATENT DOCUMENTS

| | | | |
|---|---|---|---|
| 3,194,563 | 7/1965 | MacKniesh | 273/186 R X |
| 3,601,408 | 8/1971 | Wright | 273/186 R |
| 4,146,230 | 3/1979 | Foster | 273/186 R |
| 4,155,555 | 5/1979 | Fink | 273/186 R |
| 4,254,956 | 3/1981 | Rusnak | 273/186 R |

*Primary Examiner*—George J. Marlo

*Attorney, Agent, or Firm*—Carothers and Carothers

[57] ABSTRACT

A golf practice apparatus wherein a pair of light-receiving sensors are aligned laterally of the club head path and are positioned for respectively developing signals proportional to the portions thereof which are overshadowed by a swinging golf club head at a given sensing time which is also triggered by the golf club head overshadowing a third trigger sensor. The two aligned sensors are light-receiving windows and the amount of light received from each of these windows is received by respective light sensors. The light from these sensor windows is preferably focused to respective light-diffusing surfaces from which respective light sensors read the amount of light received. The signals from these respective sensors are compared to thereby produce a resultant signal representative of the face angle of the club head which may be indicated on a meter.

8 Claims, 6 Drawing Figures

GOLF SWING TRAINING APPARATUS

CROSS REFERENCE TO RELATED APPLICATION

This application is a continuation-in-part of application Ser. No. 962,757 filed Nov. 21, 1978, now U.S. Pat. No. 4,254,956, for Golf Swing Training Apparatus.

BACKGROUND OF THE INVENTION

This invention relates generally to golf practice devices for detecting and automatically indicating the face angle of a golf club head during a practice swing at the time of ball impact.

There are a number of golf swing practice devices which determine the face angle of a golf club head at the time of ball impact, however, they are either too complex in construction and therefore expensive to manufacture or they utilize methods for detecting face angle which are not sufficiently accurate or require the use of a special golf club or a golf club with special attachments, thus preventing the golfer from using his or her own clubs. It is a principal object of the present invention to eliminate these disadvantages.

As examples of the prior art, U.S. Pat. No. 3,601,408 issued to Kenneth K. Wright used photosensors and provides circuitry for computing the direction of swing. However, Wright uses two sensors in combination for developing signals in response to the passage of the club head leading edge in order to sense the angular relation of the club head face or leading edge impact, and as such, his face angle sensing means is inaccurate in the sense that it does not take into consideration varying club head velocities.

Another example of the prior art is illustrated in U.S. Pat. No. 3,194,563 which issued to MacKniesh on July 13, 1965. He utilizes a mirror surface which is secured to the club head for reflecting a beam of light back to a series of light sensors for detecting club face angle. However, such a device requires a special attachment of the mirror to the club head, and in addition, when reflected light is utilized for the purpose of detecting face angle, a light-reflective surface of one type or another must always be positioned on the golf club head. Furthermore, when light is reflected back to one of a series of aligned light sensors to measure club face angle, it is obvious that some amount of accuracy in determining the face angle is lost due to the fact that there is spacing between the array of light sensors.

U.S. Pat. No. 4,146,230 issued to Foster on Mar. 27, 1979 discloses a prior art device for detecting club face angle. However, his device is constructed only to read club face angle with approximation, and his device does not automatically provide for velocity correction in reading the face angle. Likewise, U.S. Pat. No. 4,155,555 issued to Fink on May 22, 1979 does not provide automatic velocity correction in reading face angle. With both of these references, their sensors utilized for detecting face angle must be very accurately physically aligned in the base of the respective structures or apparatus, as any physical misalignment of their sensors will give incorrect face angle reading. In addition, these prior art structures cannot accordingly electronically adjust to correct for physical misalignment of their face angle sensors.

Other references of interest are disclosed in my copending application Ser. No. 962,757 filed on Nov. 21, 1978 for Golf Swing Training Apparatus.

SUMMARY OF THE INVENTION

The golf practice apparatus of the present invention includes structure which defines a normal path direction and a normal point of impact of a golf club head during a practice swing, and further includes mechanisms for representing the face angle of the swinging club head at the time of impact utilizing a pair of light-receiving sensors which are aligned laterally of the club head path and positioned for respectively developing signals proportional to the portions thereof which are overshadowed by a swinging club head at a triggered sensing time. An output means or device is further provided for utilizing the signals from these two sensors as a representation of the face angle of the club head and the triggered sensing time.

A preferred device for triggering the sensing time for these two light sensors is a third or trigger light sensor aligned with the club head path and positioned for developing a trigger signal when overshadowed by a swinging golf club head to energize the output means for reading of the aforementioned two sensors at this trigger sensing time. This trigger sensor will generally be centrally aligned between the aforesaid pair of light sensors.

This pair of light sensors are preferably each comprised of light-receiving windows and means to focus the light received from the entire window to respective light-sensitive sensors. In focusing the light from these sensor windows, it is also preferable that the light be focused to a light diffuser or light-diffusing surface, and the light-sensitive sensors are positioned to sense light from the diffuser. For example, the light diffuser might be a translucent plate having a light-diffusing surface and the light-sensitive sensor would then be positioned behind the plate on the side thereof opposite from which the focused light is received in order to read the amount of light on the diffusing surface. Such a translucent plate might, for example, be ground glass. Due to this arrangement, slight physical misalignments in the focusing structure for focusing light from the sensor windows to the light-diffusing surface do not affect the accuracy of the device, as the diffusing surface correctly and accurately diffuses the light received thereon for reading, even though the focal point of the light may not be accurately pinpointed on the diffusing surface.

An electrical circuit in the device of the present invention is provided to directly compare the respective developed signals from these two light sensors and thereby produce a resultant signal representative of the face angle of the club head at the triggered sensing time. This direct comparison provides for automatic velocity correction so that accurate face angles are always determined even though the velocity of the club head may drastically vary from the practice swing to another. The arrangement of the present invention also permits electrical adjustment of the signals received from the respective light sensors to correct for any physical misalignment of the light-sensitive windows in the floor of the golf practice apparatus.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
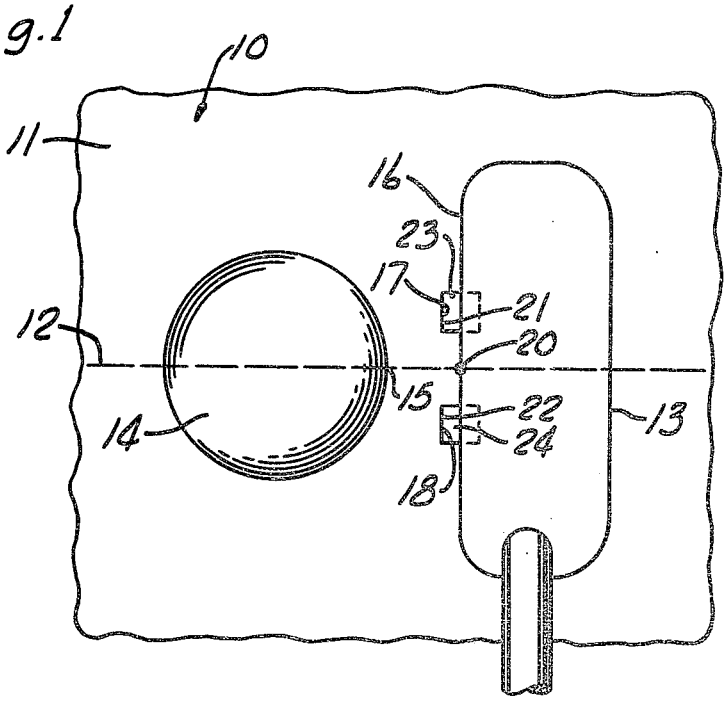
FIG. 1 is a diagrammatic plan view illustrating a golf club head, golf ball and the golf practice apparatus of the present invention.
Figure 2:
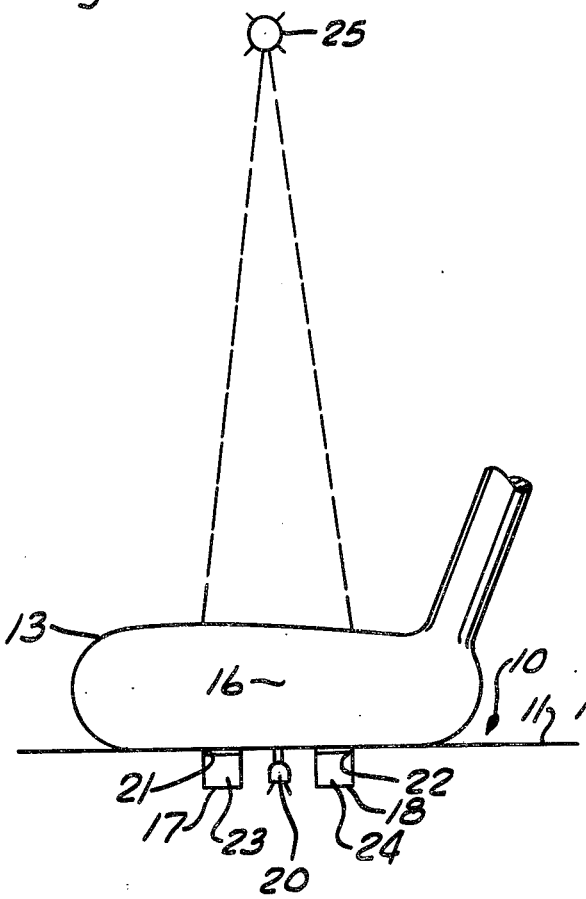
FIG. 2 is a diagrammatic view in side elevation of the golf practice apparatus illustrated in FIG. 1.
Figure 3:
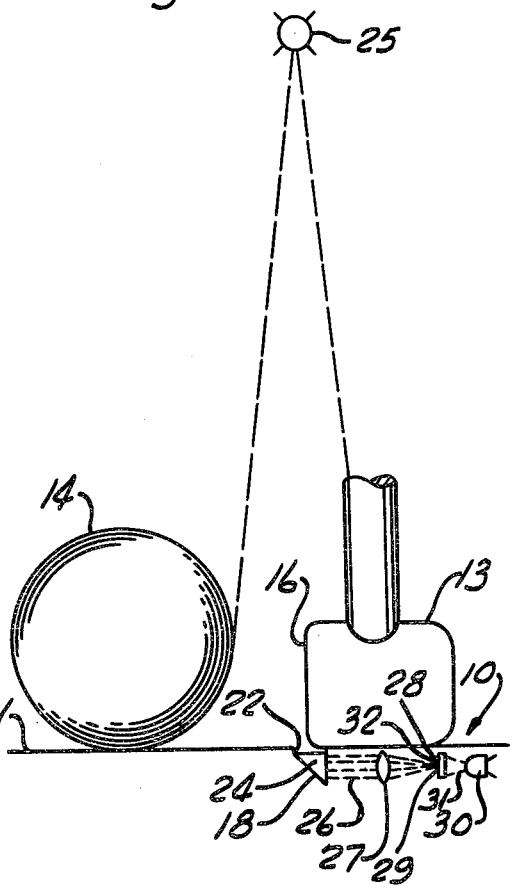
FIG. 3 is a diagrammatic view in front elevation illustrating the golf practice apparatus of FIG. 1.

Referring to FIGS. 1, 2 and 3, the golf practice apparatus 10 of the present invention includes structure 11, the floor portion of which is illustrated, and which structure 11 defines a normal path direction 12 for club 13 and golf ball 14. Structure 11 further defines the point of impact 15 for the face 16 of club head 13 to impact with golf ball 14.

The apparatus 10 provides mechanism for representing the face angle of the swinging club head which generally comprises a pair of light-receiving sensors 17 and 18 which are aligned laterally of the club head path 12 and positioned for developing signals proportional to the portions thereof which are overshadowed by a swinging club head such as club head 13 at a triggered sensing time.

As will be explained in more detail hereinafter with reference to FIG. 6, output signals from sensors 17 and 18 are utilized as a representation of the face angle of face 16 at the time of sensing, and this is indicated on meter 19 illustrated in FIG. 6.

The sensing by sensors 17 and 18 is triggered by trigger light sensor 20 which is aligned with club head path 12 and positioned for developing a trigger signal when it is overshadowed by swinging club head 13. At the time trigger sensor 20 is overshadowed, the output means illustrated in FIG. 6 is energized. Trigger light sensor 20 is further aligned with the pair of light sensors 17 and 18 so that when trigger sensor 20 is energized or overshadowed by the leading edge of club face 16, a portion of sensors 17 and 18 will also be overshadowed. The trigger sensor 20 is a conventional phototransistor.

Sensors 17 and 18 are each comprised of light-receiving windows 21 and 22 with underlying prisms 23 and 24, which receive light from lamp or light source 25 through the windows 21 and 22 and bend the light beam at right angles as indicated in FIG. 3, for space saving purposes, and directs the light beam 26 to duo-convex lens 27. Lens 27 focuses the beam onto light diffuser 28 which is a translucent ground glass plate. The light focal point is indicated at 29. Behind each light diffuser is respectively positioned a photocell or phototransistor light sensor such as the light sensor 30 indicated in FIG. 3 for sensor 18. Light sensor 30 has an entire field of view of the light-diffuser plate 28 as indicated by the dashed outline 31. Thus, phototransistor 30 reads all of the light which is focused onto the light diffuser 28.

Even if there is physical misalignment of the components in this optical system such that focal point 29 does not accurately focus onto the surface 32 of light diffuser 28, nevertheless, an accurate reading of the light received through window 22 is still obtained by light sensor 30 due to the light-diffusing capabilities of the light-diffusing surface 32 on diffuser 28.

Figure 6:
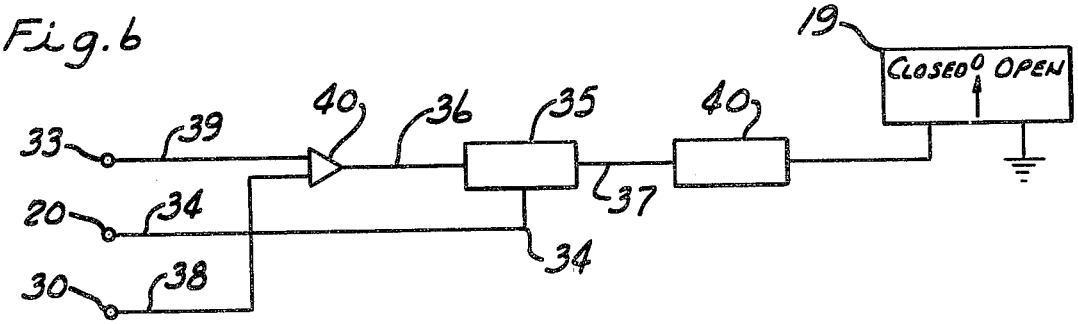
FIG. 6 is a schematic diagram illustrating the electronics for the golf practice apparatus shown in FIG. 1.

Referring to FIG. 6, reference numeral 30 indicates the light sensor or phototransistor illustrated in FIG. 3 for light sensor 18 and phototransistor 33 is the light-receiving element for light sensor 17. Phototransistor 20 is the trigger light sensor illustrated in FIG. 1.

As soon as the leading edge of club face 16 passes over trigger light sensor 20 as indicated in FIG. 1, phototransistor 20 emits a signal via conductor 34 to electronic gate 35 to close the gate. Gate 35 is nothing more than an electronic switch or a solenoid operated switch which closes a switch to connect input conductor 36 with output conductor 37. The output of phototransistors 30 and 33 is fed via conductors 38 and 39 to the input of op amp 40 which continually compares the signals from these two phototransistors 30 and 33.

If at the time the club face 16 passes over trigger light sensor 20 to close gate 35, the club face is properly angled or is square as is illustrated in FIG. 1, then the face 16 of club head 13 will directly cut windows 21 and 22 in half so that exactly 50% of each window is overshadowed by club head 13. If this occurs, then phototransistors 30 and 33 are receiving the exact same amount of reduced light through the respective windows 21 and 22, and they will therefore put out signals of equal magnitude which are directly compared by op amp 40 and the output of op amp 40 will therefore be "zero". Since gate 35 is closed, hold circuit 41 will receive and hold the signal sent by the conductor 37 and hold that value for a given time to permit display of the signal on meter 19. In the situation of FIG. 1 wherein the club is square, the signal will be zero and the meter 19 will indicate zero.

Figure 4:
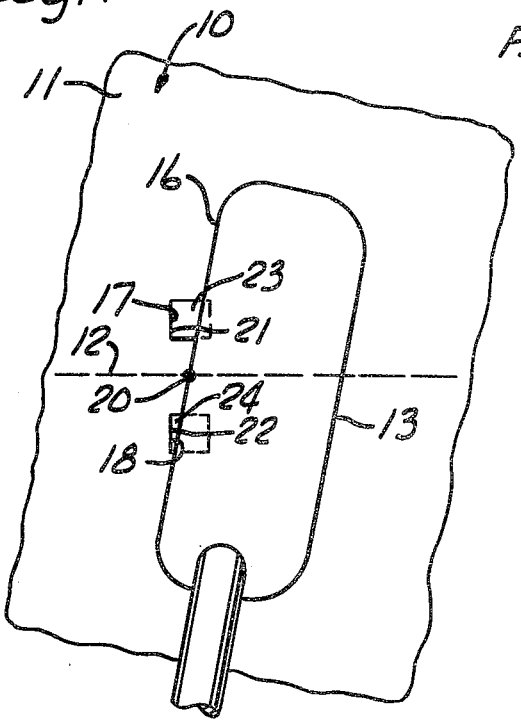
FIG. 4 is a diagrammatic plan view of the golf practice apparatus illustrated in FIG. 1 with the illustrated club head shown with its face angled open.

If during the practice swing the angle of club head 13 is slightly open as indicated in FIG. 4 when the plane of face 16 cuts the sight path of trigger sensor 20 so that club head 13 overshadows the trigger sensor 20, then sensor 20 again closes gate 35 for a short period of time, micro-seconds, and at this same period of time, it can be noted from FIG. 4 that window 21 of sensor 17 is overshadowed by the club head by only about 25%, whereas about 75% of window 22 is overshadowed by the club head. Accordingly, phototransistor 33 will receive 50% more light than phototransistor 30, and when these signals are compared in op amp 40, the output of op amp 40 will be a positive value of a magnitude equal to the difference or the face angle. This signal passes through gate 35 and is held by hold circuit 40 for a period of time so that meter 19 will continually indicate the degree to which the club face is open so that the golfer may view the indication. Hold circuit 40 may, for example, be nothing more than the combination of a field effect transistor with a capacitor at its input connected to ground.

Figure 5:
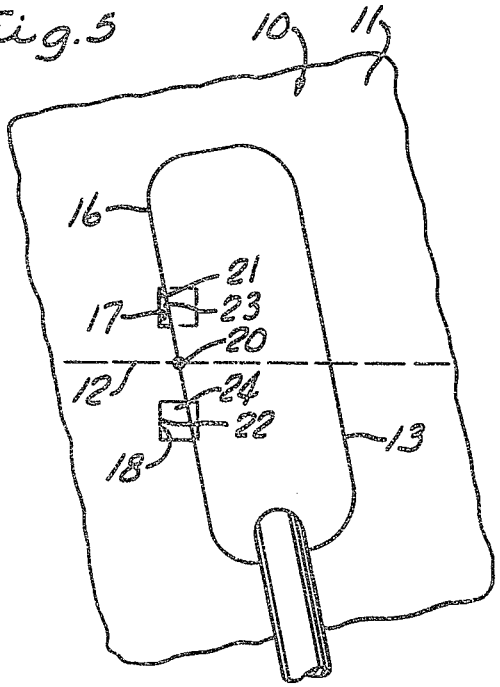
FIG. 5 is a diagrammatic plan view of the golf practice apparatus shown in FIG. 1 with the illustrated golf club head shown with its face angled in a closed position.

If at the time of ball impact, or when the club face 16 overshadows trigger sensor 20, the club face is slightly closed as indicated in FIG. 5, it may then be seen that approximately 70% of window 21 is overshadowed and only about 30% of window 22 is overshadowed. In this situation, the result will be that the negative output signal from phototransistor 30 will be greater than the positive output signal from phototransistor 33, and thus, when these signals are compared in op amp 40, the output of op amp 40 will be a negative signal with a magnitude which directly corresponds to the face angle of club face 16 at the time it passes over trigger sensor 20. Thus, in this situation, meter 19 will indicate that the club face is closed and further will indicate the exact degree to which the club face is closed. In a similar manner, hold circuit 40 will keep this indication on meter 19 for a short period of time such that the golfer may view the results afterwards.

I claim:

1. In a golf practice apparatus which includes structure defining a normal path direction and a normal point of impact of a golf club head during a practice swing, mechanism for representing the face angle of the swinging club head, comprising in combination, a pair of light-receiving sensors aligned laterally of the club head path and positioned for respectively developing signals proportional to the portions thereof which are overshadowed by a swinging club head at a triggered sensing time, and output means for utilizing the signals from said sensors as a representation of the face angle of a club head at said sensing time.

2. Mechanism as defined in claim 1, including a trigger light sensor aligned with said club head path and positioned for developing a trigger signal when overshadowed by a swinging club head to energize said output means at said sensing time.

3. Mechanism as defined in claim 2, wherein said trigger light sensor is aligned with said pair of light sensors.

4. Mechanism as defined in claim 1, wherein said sensors are each comprised of a light-receiving window and means to focus light received from the entire window to a light-sensitive sensor.

5. Mechanism as defined in claim 4, wherein said means to focus includes a light diffuser positioned to receive light focused from said window, said light-sensitive sensor positioned to sense light from said diffuser.

6. Mechanism as defined in claim 5, wherein said light diffuser is a translucent plate having a light-diffusing surface, and said light-sensitive sensor is positioned behind said plate on the side thereof opposite from which the focused light is received.

7. Mechanism as defined in claim 6, wherein said translucent plate is ground glass.

8. Mechanism as defined in claim 1, including circuit means to directly compare said respectively developed signals and thereby produce a resultant signal representative of the face angle of a club head at said sensing time.

* * * * *